US012151178B2

(12) United States Patent
Bando et al.

(10) Patent No.: US 12,151,178 B2
(45) Date of Patent: Nov. 26, 2024

(54) TOP TOY

(71) Applicant: c/o TOMY COMPANY, LTD., Tokyo (JP)

(72) Inventors: Yohei Bando, Tokyo (JP); Makoto Muraki, Tokyo (JP); Kenji Horikoshi, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 18/019,719

(22) PCT Filed: Oct. 25, 2022

(86) PCT No.: PCT/JP2022/039633

§ 371 (c)(1),
(2) Date: Feb. 3, 2023

(87) PCT Pub. No.: WO2024/075310

PCT Pub. Date: Apr. 11, 2024

(65) Prior Publication Data

US 2024/0252935 A1 Aug. 1, 2024

(30) Foreign Application Priority Data

Oct. 6, 2022 (JP) ..... 2022-161505

(51) Int. Cl.
*A63H 1/00* (2019.01)
*A63H 1/02* (2006.01)

(52) U.S. Cl.
CPC ..... *A63H 1/02* (2013.01); *A63H 1/00* (2013.01)

(58) Field of Classification Search
CPC ..... A63H 1/00
See application file for complete search history.

(56) References Cited

U.S. PATENT DOCUMENTS

| | | | | |
|---|---|---|---|---|
| 9,849,393 | B2 * | 12/2017 | Muraki | A63H 1/00 |
| 10,029,185 | B2 * | 7/2018 | Cai | A63H 1/18 |
| 2011/0256795 | A1 * | 10/2011 | Ujita | A63H 1/00 446/264 |
| 2011/0256796 | A1 * | 10/2011 | Ujita | A63H 1/00 446/264 |
| 2018/0243660 | A1 * | 8/2018 | Horikoshi | A63H 1/02 |
| 2020/0114271 | A1 * | 4/2020 | Muraki | A63H 1/02 |

FOREIGN PATENT DOCUMENTS

JP 3087507 U 5/2002

* cited by examiner

*Primary Examiner* — John A Ricci
(74) *Attorney, Agent, or Firm* — IP Business Solutions, LLC.

(57) ABSTRACT

A top toy includes a trunk part having an insertion hole, first and second shafts, a locking part being configured on the trunk part to lock first and second locked parts and to hold the first and second shafts. The first and second shafts are interchangeable. When the first shaft is employed, the first shaft is inserted in the insertion hole. When the first shaft is employed, the locking part is configured to hold the first shaft elastically and radially inwardly. When the second shaft is employed, the second shaft is inserted in the insertion hole. When the second shaft is employed, the locking part is configured to hold the second shaft elastically and radially inwardly.

6 Claims, 10 Drawing Sheets

TOP TOY

CROSS-REFERENCE TO THE RELATED APPLICATION

This is National Phase application of PCT Application No. PCT/JP2022/039633 filed on Oct. 25, 2022 which claims priority to Japanese Patent Application No. 2022-161505 filed on Oct. 6, 2022. The entire content of Japanese Patent Application No. 2022-161505 is incorporated herein by reference.

BACKGROUND

Technical Field

The present invention relates to a top toy.

Background Art

Known from the past are top toys with a fitting hole, in which a rotating shaft can be freely inserted and removed, is formed in the bottom center of the toy body, configured so that both ends of the rotating shaft can be switched and fitted into the fitting hole (see Patent Document 1).

According to this top toy, one end of the rotating shaft is formed in a flat plane shape, and the other in a cone shape, making it possible to change the rotation characteristics of the top toy before and after switching the rotating shaft.

Patent Document 1: Japanese Utility Model Registration No. 3087507

SUMMARY

Problems the Invention is Intended to Solve

In this top toy, to prevent the rotating shaft from coming out, the rotating shaft is constituted using a metal which is a magnetic body, and a magnet that attracts the rotating shaft by magnetic force is installed inside the toy body.

However, because the shaft end of the rotating shaft is thin, particularly to effectively attract the cone shaped shaft end, an expensive magnet having a considerable attractive force is necessary, and it is necessary to constitute the rotating shaft using a magnetic body.

The invention of the present application was created considering these circumstances, and its purpose is to provide a top toy in which it is possible to easily exchange the shaft without using a magnet, and the rotation characteristics can be changed.

Means for Solving the Problems

A top toy includes a trunk part, first and second shafts, and a locking part. The trunk part has an insertion hole. The first shaft has a first locked part. The second shaft has a second locked part. The first and second shafts are interchangeable. The locking part is configured on the trunk part to lock the first and second locked parts and to hold the first and second shafts. When the first shaft is employed, the first shaft is inserted in the insertion hole. When the first shaft is employed, the locking part is configured to hold the first shaft elastically and radially inwardly. When the second shaft is employed, the second shaft is inserted in the insertion hole. When the second shaft is employed, the locking part is configured to hold the second shaft elastically and radially inwardly.

DETAILED DESCRIPTION OF PREFERRED EMBODIMENTS

Hereafter, a top toy according to an embodiment of the present invention is explained.

General

Figure 1:
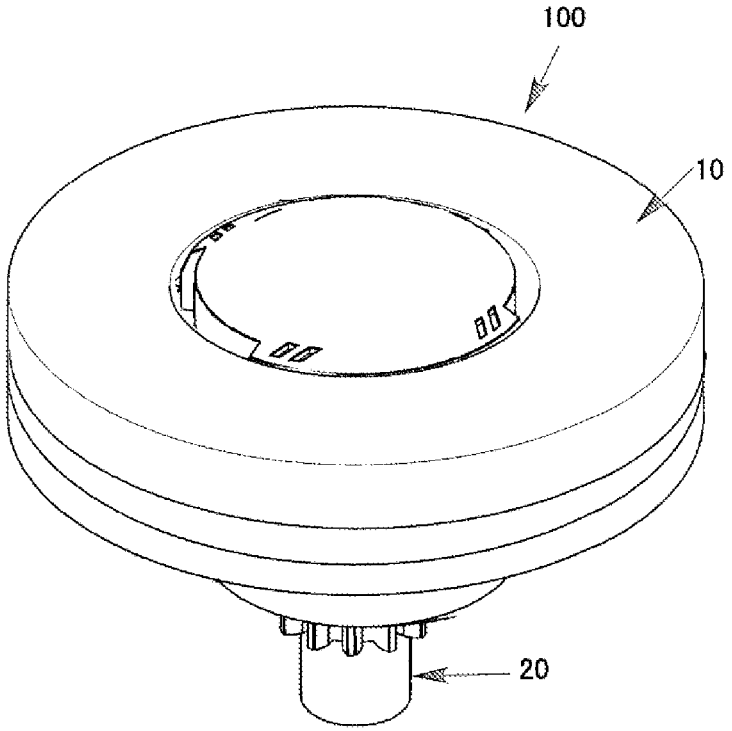
FIG. 1 is a perspective view of a top toy according to an embodiment.
Figure 2:
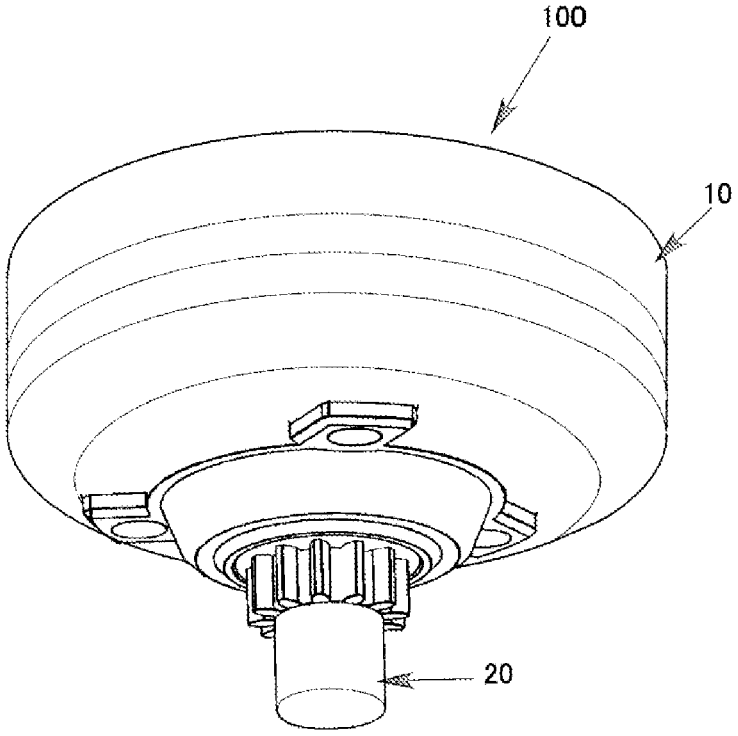
FIG. 2 is a perspective view of the top toy seen from below.

FIG. 1 is a perspective view of a top toy 100 according to an embodiment, and FIG. 2 is a perspective view of the top toy 100 seen from the bottom surface side.

This top toy 100 comprises a trunk part 10 and a shaft 20. The shaft 20 is detachable with a toy body that includes the trunk part 10, and can be exchanged with other prepared shafts. By exchanging this shaft, it is possible to change the rotation characteristics of the top toy 100.

Hereafter, details of this top toy 100 are explained.

Trunk Part 10

Figure 3:
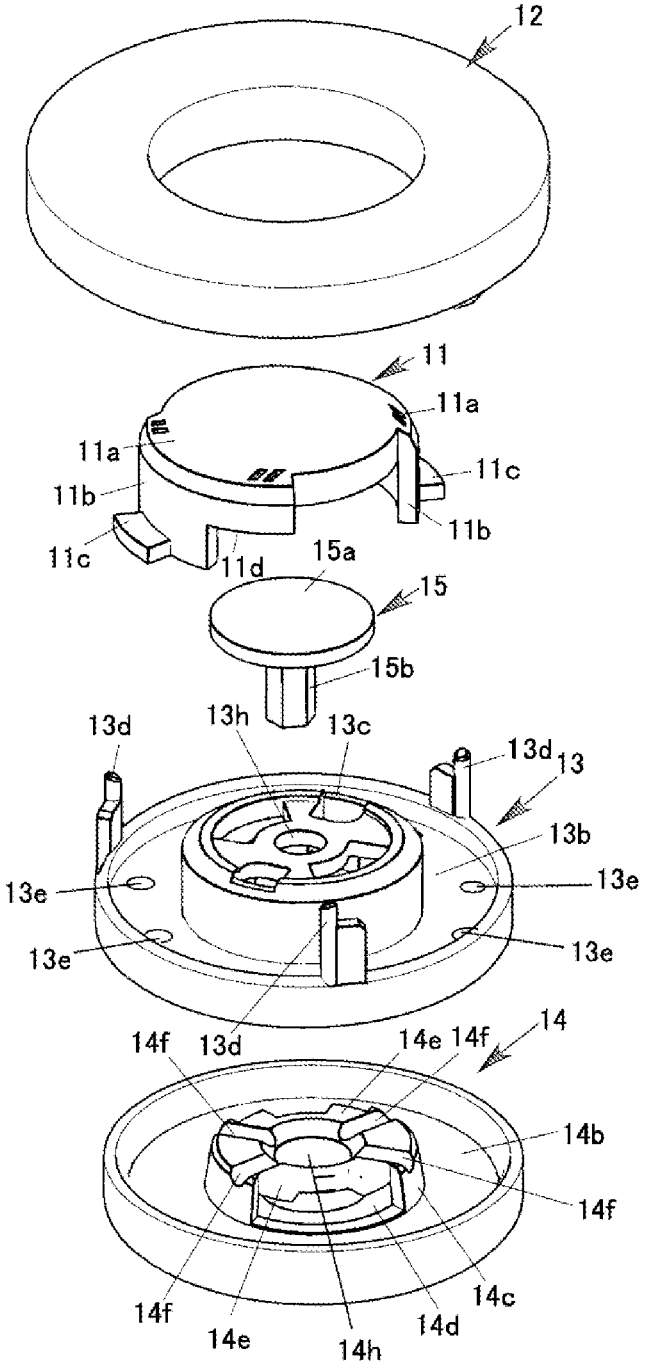
FIG. 3 is an exploded perspective view of a trunk part.
Figure 4:
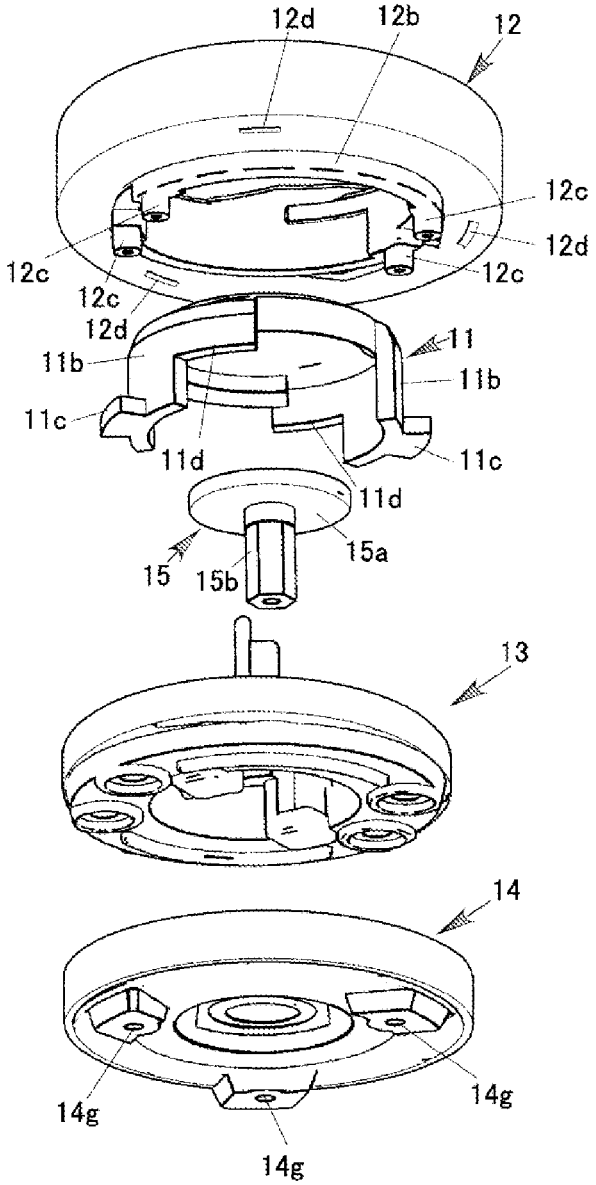
FIG. 4 is an exploded perspective view of the trunk part seen from below.

FIG. 3 is an exploded perspective view of the trunk part 10, and FIG. 4 is an exploded perspective view of the trunk part 10 seen from below.

The trunk part 10 constitutes the top structure of the top toy 100, and comprises a top plate 11, an upper layer member 12, a middle layer member 13, and a lower layer member 14.

Top Plate 11

The top plate 11 is arranged on the top surface center of the trunk part 10, and has an approximately circular shape in the plan view. Two locations facing opposite sandwiching the center of the top plate 11 overhang radially outward in an arc shape, a leg 11*b* that hangs downward is formed on each arc-shaped overhang part 11*a*, and a projecting piece 11*c* that overhangs radially outward is formed on the bottom edge part of the leg 11*b*. One end in the circumferential direction of the leg 11*b* is cut out in step form. A locked part 11*d* is formed in this stepped cutout part. This locked part 11*d* is used when rotationally energizing the top toy 100.

Upper Layer Member 12

The upper layer member 12 is formed in a ring shape. Here, the upper layer member 12 has a short cylinder shape, but it is also possible to have fin-shaped projections formed on the outer periphery of the upper layer member 12. On the lower side of the upper layer member 12, a ring-shaped step part 12*b* that fits in the middle layer member 13 is formed, and a plurality of cylindrical female threaded bosses 12*c* are formed. Furthermore, a mating hole 12*d* is formed on the bottom surface of the upper layer member 12. The top plate 11 is inserted from below in the opening at the center of the upper layer member 12. At this time, the projecting piece 11*c* of the top plate 11 abuts the bottom surface of the upper layer member 12, preventing the top plate 11 from coming out upward. An arc-shaped recess is formed between the outer periphery of the top plate 11 and the inner periphery of the upper layer member 12 between adjacent arc-shaped overhang parts 11*a* of the top plate 11.

This arc-shaped recess is used when rotationally energizing the top toy 100.

Middle Layer Member 13

Figure 5:
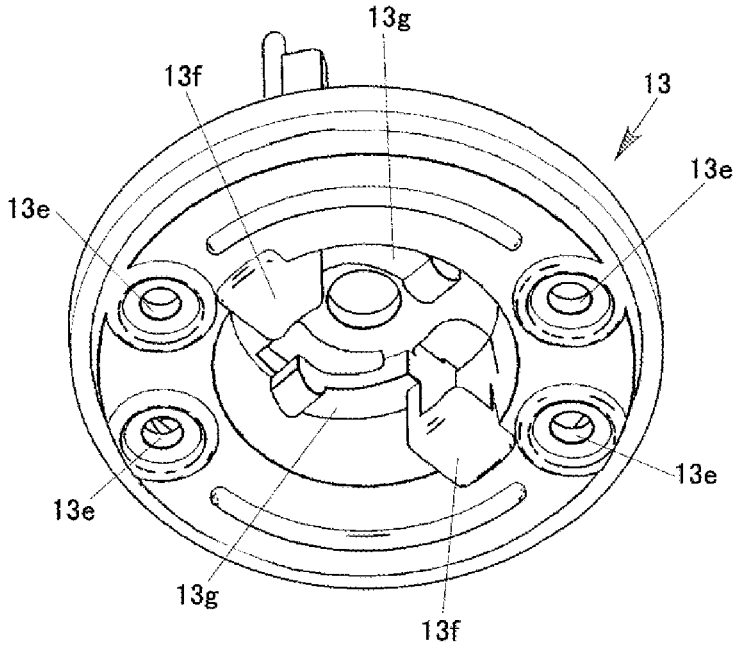
FIG. 5 is a perspective view of a middle layer member seen from below.

FIG. 5 is a perspective view of the middle layer member 13 seen from below.

The middle layer member 13 is formed in a disk shape. Fin-shaped projections, for example, may also be formed on the outer periphery of the middle layer member 13. On the top surface of the middle layer member 13, a ring-shaped recess 13*b* is formed centered on the shaft 20, and a ceilinged cylindrical bulging part 13*c* is formed at the center. The lower side of the bulging part 13*c* is hollow. A hole 13*h* through which a core rod 15*b* of a disk 15 described later is inserted is formed on the ceiling of the bulging part 13*c*. Furthermore, fitting projections 13*d* that fit in mating holes 12*d* of the upper layer member 12 are erected on the outer periphery part of the middle layer member 13. Insertion through holes 13*e* corresponding to the bosses 12*c* of the upper layer member 12 are formed on the middle layer member 13. Then, by screwing male screws (not illustrated) that pass through the insertion through holes 13*e* from below the middle layer member 13 into the female threads of the bosses 12*c*, the middle layer member 13 is attached to the upper layer member 12. At this time, the top plate 11 is covered by the bulging part 13*c*, the projecting pieces 11*c* of the top plate 11 ride on the recess 13*b* of the middle layer member 13, and the projecting pieces 11*c* are pinched by the upper layer member 12 and the middle layer member 13.

As shown in FIG. 5, engaging pieces 13*f* and elastic positioning pieces 13*g* are formed under the bulging part 13*c* on the middle layer member 13. The engaging pieces 13*f* are for joining the middle layer member 13 and the lower layer member 14. Claws are formed on the elastic positioning pieces 13*g*, and the middle layer member 13 and the lower layer member 14 are positioned by the claws.

Lower Layer Member 14

The lower layer member 14 is formed in a round tray shape. Fin-shaped projections, for example, may be formed on the outer periphery of the lower layer member 14. A ring-shaped recess 14*b* centered on the shaft 20 is formed on the top surface of the lower layer member 14, and a ceilinged cylindrical bulging part 14*c* is formed in the center. The lower side of this bulging part 14*c* is hollow. A portion of the wall of the bulging part 14*c* is cut out. Engaging pieces 14*e* that engage with the engaging pieces 13*f* are formed on this cutout part 14*d*.

For engaging of the engaging pieces 13*f* and the engaging pieces 14*e*, the bulging part 13*c* of the middle layer member 13 is made to cover the bulging part 14*c* of the lower layer member 14, the lower layer member 14 and the middle layer member 13 are superimposed, and the middle layer member 13 is rotated relatively clockwise with respect to the lower layer member 14. At this time, the top surface of the engaging pieces 13*f* and the bottom surface of the engaging parts 14*e* are abutted. At this time, the claws of the elastic positioning pieces 13*g* are fitted in grooves 14*f* on the bulging part 14*c* for positioning.

A plurality of female threads 14*g* are formed on the bottom surface of the lower layer member 14. A hole 14*h* is formed in the center of the lower layer member 14.

Tack-Shaped Member 15

A tack-shaped member 15 supports the shaft 20.

The tack-shaped member 15 comprises a disk 15*a* constituting a head, and the core rod 15*b* is provided perpendicularly at the center of the disk 15*a*.

Inside the trunk part 10, the disk 15 is provided between the top plate 11 and the bulging part 13*c* of the middle layer member 13, and can rotate around the shaft 20. The cross section of the core rod 15*b* is a square shape, and passes through the hole 13*h* of the middle layer member 13. This core rod 15*b* is internally fitted in the shaft 20 described later.

Shaft Mounting Member 31

Figure 6:
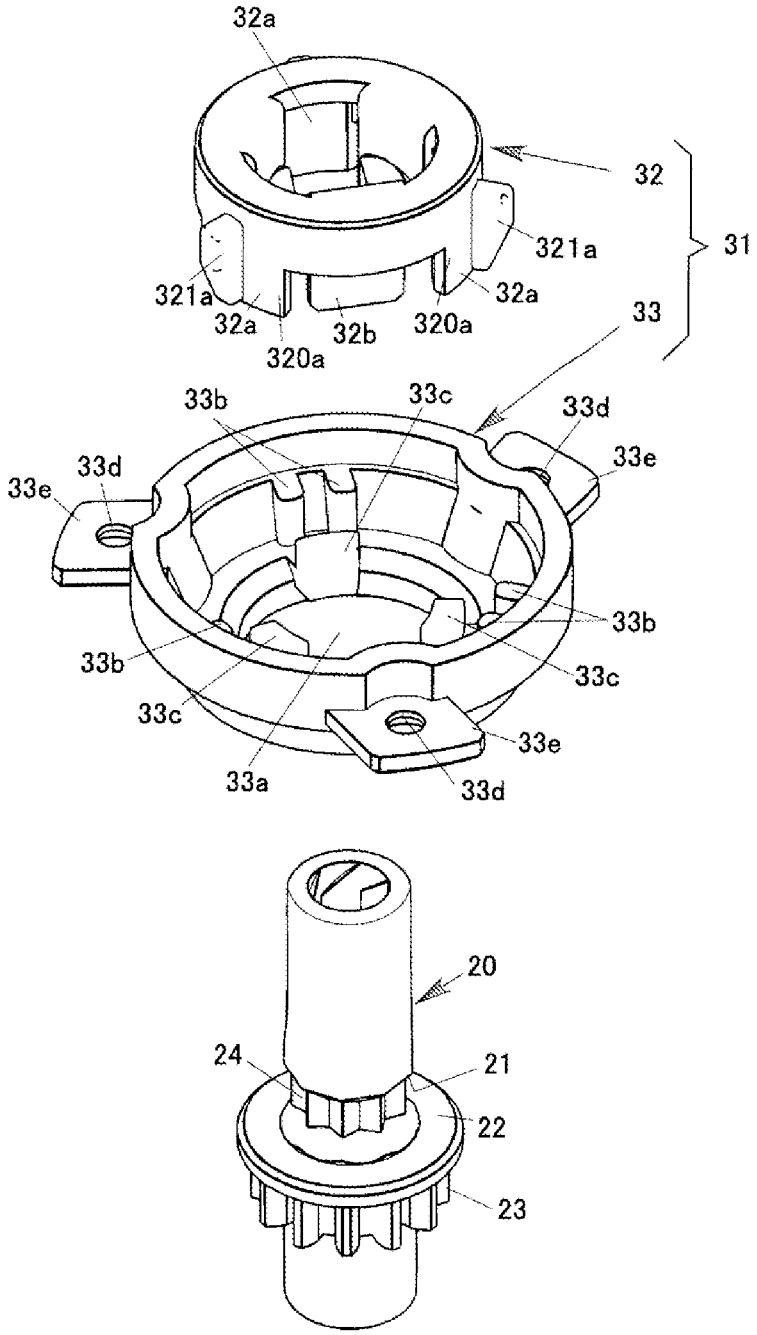
FIG. 6 is an exploded perspective view of a bottom structure.
Figure 7:
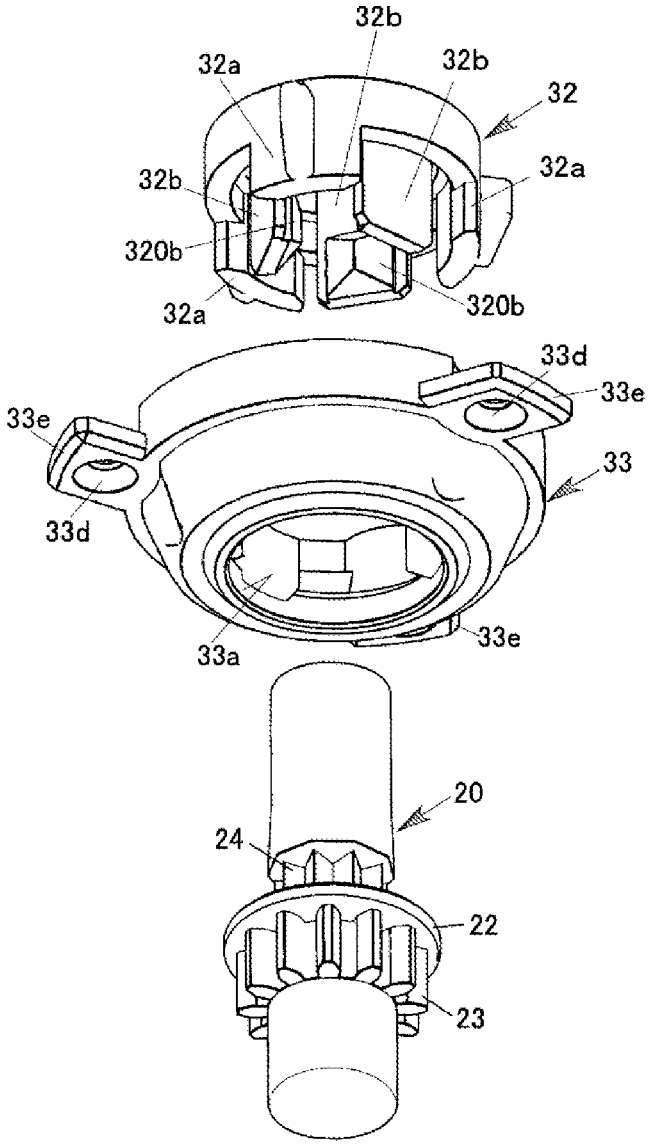
FIG. 7 is a perspective view of the bottom structure seen from below.

FIG. 6 is an exploded perspective view of the bottom structure of the top toy 100, and FIG. 7 is an exploded perspective view of the bottom structure seen from below.

The bottom structure is constituted from a shaft mounting member 31 and the shaft 20, and the shaft mounting member 31 together with the trunk part 10 constitute the toy body. This toy body is constituted mostly from plastic. It may also of course include metal.

The shaft mounting member 31 is provided under the lower layer member 14.

The shaft mounting member 31 comprises a locking ring 32 and a ring support member 33.

On the locking ring 32, three hanging downward insertion parts 32*a* and elastic pieces 32*b* each are formed alternately in the circumferential direction. This number is not limited to being three. It is also possible to use one elastic piece 32*b*, for example.

Of these, the insertion parts 32*a* are constituted from a bottom-view arc-shaped first insertion piece 320*a*, and a second insertion piece 321*a* extending outward from the circumferential direction center of the outer surface of the first insertion piece 320*a*.

On the bottom part inside of the elastic pieces 32*b* are formed claws (locking parts) 320*b* having a slope in four directions in the form of a hipped roof.

Meanwhile, the ring support member 33 is formed in a bowl shape, and has an insertion hole 33*a* of the shaft 20 formed in the center.

On the inner periphery surface of the ring-shaped member 33, a pair of projections 33*b*, 33*b* are formed facing each other with the second insertion piece 321*a* inserted therebetween.

On the inner periphery part of the ring-shaped bottom surface of the ring support member 33, projections 33*c* are formed so that the first insertion pieces 320*a* can be inserted between them and the projections 33*b*.

Furthermore, on the upper part outer periphery of the ring support member 33, three outward facing projecting pieces 33*e* in which insertion through holes 33*d* are formed at equal intervals in the circumferential direction.

By screwing male screws (not illustrated) passed through the insertion through holes 33*d* from below the ring support member 33 into the female threads 13*e* of the lower layer member 14, the ring support member 33 is attached to the lower layer member 14. Before this, the locking ring 32 is assembled inside the ring support member 33.

Shaft 20

A circular hole is formed on the top end of the shaft 20, and the core rod 15*b* is inserted in this hole. In this case, the shaft 20 fits with respect to the core rod 15*b*. The shaft 20 is not limited to being a single component, and may also be configured by joining a plurality of components.

A constricted part (locked part) 21 is formed in the vertical direction center part of the shaft 20, and the claws 320*b* of the elastic pieces 32*b* are fitted in this constricted part 21. As a result, the shaft 20 is picked up and held by the claws 320*b*. Gear 22 is formed on the constricted part 21, and the claws 320*b* mesh with the gear 22.

Below the constricted part 21, a flange part 22 is formed that overhangs radially outward. The flange part 22 is fitted into the bottom surface of the ring support member 33 when the shaft 20 is inserted into the insertion hole 33*a* of the ring support member 33 from below.

Gear 23 that meshes with teeth 93*a* of a battle stadium 90 described later is formed below the flange part 22.

Rotational Resistance Between the Toy Body and the Shaft 20

Figure 8:
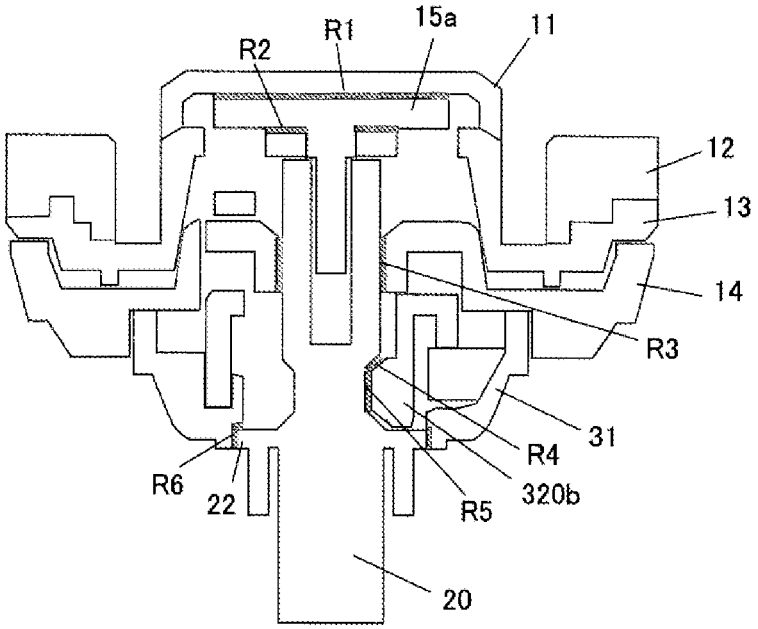
FIG. 8 is a drawing showing a rotational resistance part that is created between a toy body and a shaft.

FIG. 8 shows the rotational resistance part that is created between the toy body and the shaft 20. The gear 22 is formed on the constricted part 21 of the shaft 20 noted above, but here, the shaft 20 includes shafts in which the gear 22 is not formed on the constricted part 21, and these are explained collectively.

A rotational resistance part R1 is a frictional resistance part that is created by sliding contact between the disk 15*a* that rotates integrally with the shaft 20 and the top plate 11.

A rotational resistance part R2 is a frictional resistance part that is created by sliding contact between the disk 15*a* and the middle layer member 13.

A rotational resistance part R3 is a frictional resistance part that is created by sliding contact between the lower layer member 13 and the outer circumference of the shaft 20.

A rotational resistance part R4 is a frictional resistance part that is created by sliding contact between the side wall of the constricted part 21 and the claws 320*b*. Also, a rotational resistance part R5 is a frictional resistance part that is created by sliding contact between the bottom wall of the constricted part 21 and the claws 320*b*. This is when there is no gear 22 on the constricted part 21, and when there is a gear 22 on the constricted part 21, rotational resistance is created on the basis of meshing as rotational resistance between the gear 22 and the claws 320*b*.

A rotational resistance part R6 is a frictional resistance part that is created by sliding contact between the outer periphery of the flange part 22 and the shaft mounting member 31.

Of these, the rotational resistance parts R3 to R6 are rotational resistance that is created by sliding contact directly between the toy body and the shaft 20, and by exchanging of the shaft 20, if the diameter of the shaft 20 and the depth or shape, etc., of the constricted part 21 are changed, it is possible to change the rotational resistance.

Top Shooting Device

Figure 9:
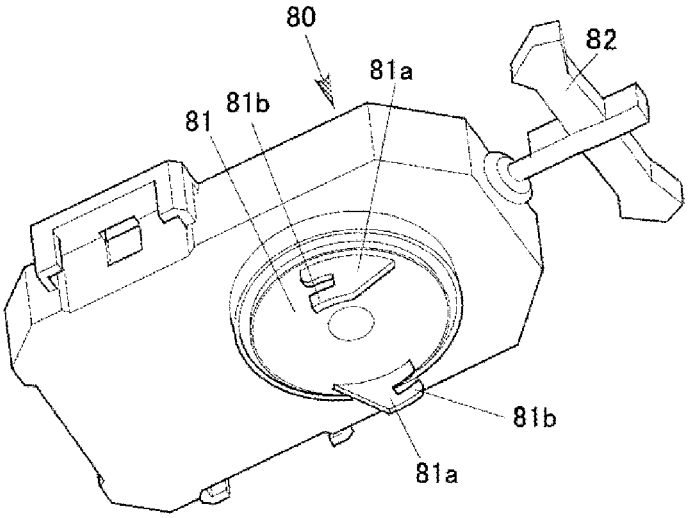
FIG. 9 is a perspective view of a top shutting toy seen from below.

FIG. 9 is a perspective view showing a top shooting device 80.

The top shooting device 80 comprises a top holder 81 that holds the rotationally energized top toy 100. The top holder 81 is provided with two insertion pieces 81*a* corresponding to the arc-shaped recess of the top toy 100. A locking part 81*b* that projects in the rotationally energized direction is formed on the insertion piece 81*a*. After the insertion piece 81*a* is inserted in the arc-shaped recess of the top toy 100, the top toy 100 is rotated relatively in the direction opposite to the rotationally energized direction of the top toy 100 with respect to the top holder 81, and by the locking part 81*b* getting under the locked part 11*d* of one end part of the arc-shaped recess, the top toy 100 is attached to the top holder 81.

A handle 82 is provided on the top shooting device 80, and one end of a cord (not illustrated) is attached to this handle 82. The cord is wound on an input rotor (not illustrated) by the restoring force of a mainspring, and by operating the handle 82 to pull the cord, rotational force is inputted to the input rotor. The input rotor is coupled to the top holder 81, which is rotated by the rotation of the input rotor.

With this top shooting device 80, the top toy 100 attached to the top holder 81 is rotationally energized by rotating the top holder 81 by operating the handle 82. When operation of the handle 82 is stopped, while rotation of the top holder 81 stops, the top toy 100 continues rotating due to inertial force, so the locking part 81*b* separates from below the locked part 11*d* of the arc-shaped recess and the top toy 100 is shot. Here, the input rotor coupled to the top holder 81 was rotated using a cord, but it is also possible to use a gear for the input rotor coupled to the top holder 81, with the gear rotated by a rack belt having a belt part on which a rack is formed.

Battle Stadium 90

Figure 10:
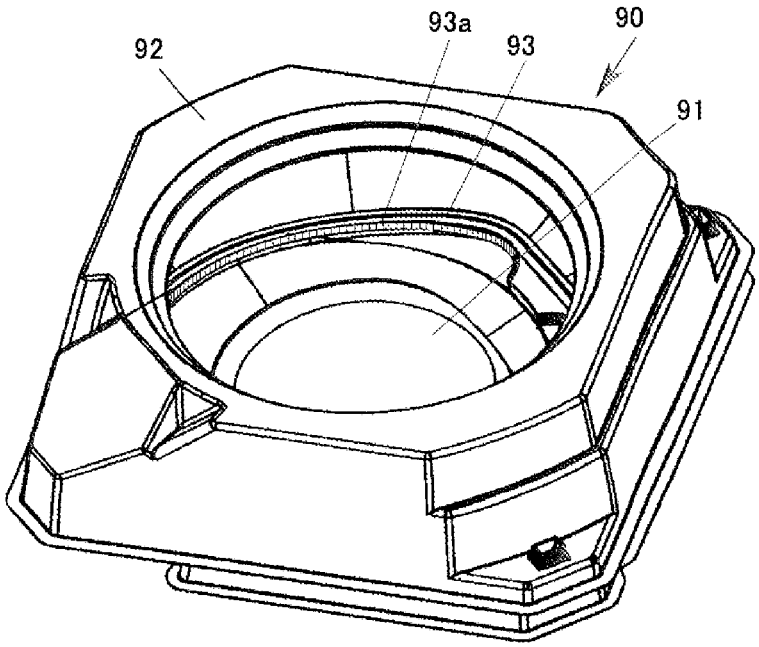
FIG. 10 is a perspective view of a battle stadium.

FIG. 10 is a perspective view showing the external appearance of the battle stadium 90.

The bottom surface of a field 91 of the battle stadium 90 is a concave curved surface, and the field 91 is covered by a transparent cover 92 with an open center. A guide section 93 on which are formed teeth 93*a* that mesh with the gear 23 of the shaft 20 of the top toy 100 that moves around inside the field 91 is arranged in the field 91.

With this battle stadium 90, by meshing the teeth 93*a* with the gear 23 of the shaft 20 of the top toy 100, the top toy 100 is rolled with respect to the guide section 93, and it is possible to increase the speed at which the top toy 100 moves around.

Shaft 20 Types and Rotation Characteristics

Figure 11A:
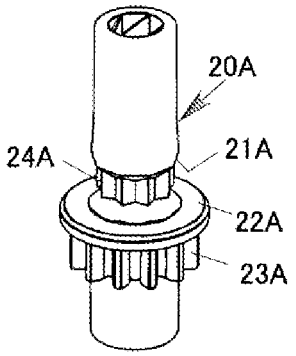
FIG. 11A is a perspective view showing a shaft type.
Figure 11B:
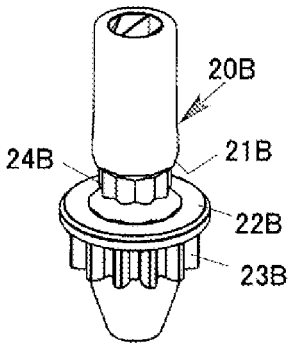
FIG. 11B is a perspective view showing a shaft type.
Figure 11C:
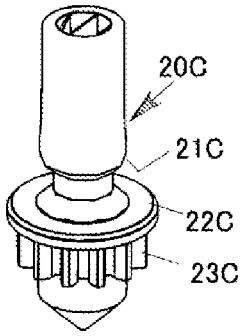
FIG. 11C is a perspective view showing a shaft type.

FIG. 11A to FIG. 11C show examples of shafts 20A to 20C that are compatible.

1. Shaft 20A

A shaft 20A is the same as the shaft 20. A gear 24A is formed inside a constricted part 21A. This gear 24A meshes with the claws 320*b*. As a result, rotation of the shaft 20 with respect to the lower layer member 14 is suppressed. Meanwhile, the tip of the shaft 20A is flat. For that reason, it is easy to move around a lot. The rotation of the shaft 20 with respect to the lower layer member 14 is also strongly suppressed by meshing of the gear 24A and the claws 320*b*, so when a gear 23A abuts the guide section 93, it is easy for the movement to accelerate.

2. Shaft 20B

In this shaft 20B, the first point that differs from the shaft 20A is that the cross section of the inside of a constricted part 21B (cross section orthogonal to the shaft 20B) is square. In this shaft 20B, the second point that differs from the shaft 20A is that a taper is formed on the tip part and the diameter of the bottom surface (tip surface) is smaller than that of the shaft 20A. As a result, compared to the case of the shaft 20A, in the top toy 100, the shaft 20 rotates more easily with respect to the lower layer member 14, and the diameter of the tip is smaller, so it doesn't move around easily.

When the lower layer member 14 and the shaft 20B rotate relatively around the shaft 20B, the polygonal surface (sliding contact surface) of the constricted part 21B generates frictional resistance by having sliding contact with the claws 320*b*, and since the rotation of the shaft 20 with respect to the lower layer member 14 is suppressed to a degree, when a gear 23B abuts the guide section 93, though not as much as with the shaft 20A, the movement is accelerated. At that time, rotation of the shaft 20 with respect to the lower layer member 14 is done to a degree, so, it is easier to bite into the guide section 93 compared to the shaft 20A.

3. Shaft 20C

In a shaft 20C, the bottom cross section of a constricted part 21C is circular, and the tip part is pointed like a cone. As a result, movement is not accelerated easily when a gear 23C abuts the guide section 93, but it easily bites into the guide section 93, so the top toy 100 is not repelled easily by the guide section 93, and movement along the guide section 93 is easier. In this case, by changing the shape or thickness of the constricted part 21 is changed, when the lower layer member 14 and the shaft 20C rotate relatively around the shaft 20C, it is possible for the surface (sliding contact surface) of the constricted part 21C to be in sliding contact with the claws 320*b* and generate frictional resistance, or to change the size of the frictional resistance.

The features of these shafts 20A to 20C can be combined freely as long as they do not contradict each other.

Modification Examples

Figure 12:
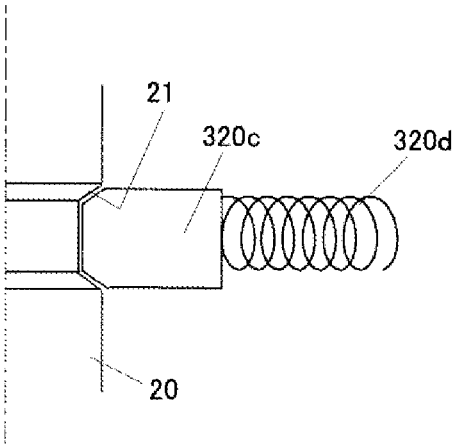
FIG. 12 is a drawing showing a modification example of a shaft holding structure.

In the above embodiments, the shaft 20, etc., was held by the constricted part (locked part) 21, etc., being picked up by the elastic pieces 32*b* having the claws (locking parts) 320*b*, but as shown in FIG. 12, the configuration can also be such that claws (locking parts) 320*c* are provided to be able to move in the radial direction, with radially inward energization done by a coil spring 320*d*.

Also, with the above embodiments, the disk 15 was provided to be able to rotate around the shaft 20 between the top plate 11 and the bulging part 13*c* of the middle layer 13, but the disk 15 may also be provided without being able to rotate. It is also possible to provide the core rod 15*b* fixed to the top plate 11 and the middle layer member 31. Furthermore, by making the rotation of the disk 15 dull by friction, it is possible to provide a function of suppressing the rotation of the shaft 20 to some degree.

Furthermore, with the embodiments, the gear 23 was fixed to the shaft 20, but it is also possible to provide it to be able to spin idly in relation to the shaft 20.

The invention is not limited to having the teeth 93*a* formed on the guide section 93 with the gear 23 provided on the shaft 20, etc. The invention can also be applied to items in which teeth 93*a* do not exist on the guide section 93. It is sufficient provided that the movement of the top toy 100 can be changed by the outer periphery of the shaft 20, etc., of the top toy 100 abutting, and the shaft 20 rolling. For example, it is possible to constitute the entirety or the surface layer of the outer periphery of the shaft 20, etc., using rubber, to create stronger friction than a normal case (plastic or metal). In this case, it is also possible to configure the part that creates strong friction using a roller that overhangs radially outward from the shaft 20, etc.

In the above embodiments, the cross section of the core rod 15*b* was square, and the core rod 15*b* was internally fitted in the shaft 20, but it is also possible to fit the shaft head in the hole part instead of the core rod 15*b*.

In the above embodiments, the configuration was such that the shaft 20 rotates integrally with the core rod 15*b*, but it is also possible to configure so that the shaft 20 can rotate with respect to the core rod 15*b*.

Furthermore, in the above embodiments, the constricted part (locked part) 21, etc., was provided on the shaft 20 and the claws (locking parts) 320*b* were fitted in this, but it is also possible to configure by providing flange-shaped projections (locked parts) of the shaft 20, so that the shaft 20 is prevented from coming out by locking using locking parts such as the claws, etc.

The modifications above can be combined freely provide they do not contradict each other.

INDUSTRIAL APPLICABILITY

The top toy of the present invention can be suitably used in the field of top toy manufacturing.

Effect of the Invention

According to the present invention, by engaging the locking part using elastic force to the locked part provided on the shaft, the shaft is held, so it is possible to exchange the shaft easily, and the rotation characteristics can be changed.

The invention claimed is:

1. A top toy comprising:

a trunk part having an insertion hole;

first and second shafts, the first shaft having a first locked part, the second shaft having a second locked part; and a locking part being configured on the trunk part to lock the first and second locked parts and to hold the first and second shafts, the first and second shafts being interchangeable, when the first shaft is employed, the first shaft being inserted in the insertion hole, when the first shaft is employed, the locking part being configured to hold the first shaft elastically and radially inwardly, when the second shaft is employed, the second shaft being inserted in the insertion hole, when the second shaft is employed, the locking part being configured to hold the second shaft elastically and radially inwardly.

2. The top toy according to claim 1, wherein the first shaft includes a portion projecting downward from the trunk part, and the first shaft includes a first gear being configured to mesh with teeth formed on an external guide section.

3. The top toy according to claim 2, wherein the first shaft is rotatable relatively to the trunk part, and the first shaft includes a sliding contact surface that slidably contacts the locking part to generate frictional resistance during relative rotation against the trunk part.

4. The top toy according to claim 2, wherein the first shaft is rotatable relatively to the toy body, the first shaft includes a second gear being configured to mesh with the locking part.

5. The top toy according to claim 1, wherein the first locked part is constituted by a constricted part formed on an outer periphery of the shaft, and the locking part is constituted by an elastic piece being configured to mesh with the constricted part.

6. The top toy according to claim 1, wherein the first locked part is constituted by a constricted part formed on an outer periphery of the shaft, and the locking part is urged by a coil spring and is constituted by a claw that fits in the constricted part.

* * * * *